US005548976A

United States Patent [19]

Slowinski

[11] Patent Number: 5,548,976

[45] Date of Patent: Aug. 27, 1996

[54] PRECIOUS STONE MOUNTING AND METHOD THEREFOR

[75] Inventor: Christopher Slowinski, Bellerose, N.Y.

[73] Assignee: Christopher Designs, Inc., New York, N.Y.

[21] Appl. No.: 342,144

[22] Filed: Nov. 18, 1994

[51] Int. Cl.[6] ..... A44C 17/02

[52] U.S. Cl. ..... 63/28

[58] Field of Search ..... 63/26, 28; 29/10

[56] References Cited

U.S. PATENT DOCUMENTS

| | | | |
|---|---|---|---|
| 755,654 | 3/1904 | Guild | 63/28 |
| 795,109 | 7/1905 | Dover | 63/26 |
| 1,192,092 | 7/1916 | Morse | 63/28 |
| 1,328,948 | 1/1920 | Dover | 63/28 |
| 1,442,815 | 1/1923 | Maker et al. | 63/28 |
| 1,539,940 | 6/1925 | Gaschke | 63/26 |
| 1,863,617 | 6/1932 | Brogan | 63/26 |
| 4,566,294 | 1/1986 | Brzozowski | 63/15 |
| 4,748,728 | 6/1988 | Magnien et al. | 63/28 |
| 5,072,601 | 12/1991 | Slowinski | 63/28 |
| 5,218,839 | 6/1993 | Udko | 63/26 |
| 5,365,754 | 11/1994 | Nalbandian | 63/26 |

FOREIGN PATENT DOCUMENTS

| | | | |
|---|---|---|---|
| 3342021 | 5/1985 | Germany | 63/26 |

*Primary Examiner*—Michael J. Milano

*Attorney, Agent, or Firm*—Ostrolenk, Faber, Gerb & Soffen, LLP

[57] ABSTRACT

A setting for diamonds in a jewelry piece includes an annular groove defined by upstanding, spaced walls and a base. The groove is bordered by two upstanding rims and diamonds are placed in the groove in a row in abutting relationship. The diamonds are supported on ledges that are formed between the walls and the rims, on sharp pointed edges which comprise a small amount of yielding gold material to allow the diamonds to be precisely aligned height-wise relative to one another. The rims are overturned on the peripheries, i.e. crowns of the diamonds to clamp the diamonds in the groove.

15 Claims, 3 Drawing Sheets

PRECIOUS STONE MOUNTING AND METHOD THEREFOR

BACKGROUND OF THE INVENTION

The present invention relates to method for setting precious and semi-precious stones, typically diamonds, and to jewelry pieces including precious stones which have been set in accordance with the principles of the method of the present invention.

In his prior U.S. Pat. No. 5,072,601, the present inventor disclosed a precious stone setting method involving providing a setting which comprises substantially parallel, flat-surface walls, that are spaced apart to define channels in which a plurality of diamonds are set in line following one another. In the present inventor's prior patent, the diamonds themselves are processed to have sharp upwardly pointing edges. These edges then bite into the walls to hold the diamonds firmly and securely in the channels.

U.S. Pat. No. 4,566,294 describes a method for mounting gems. In accordance with FIGS. 1 and 2 of that patent (presented here as FIGS. 1 and 2), a ring body 10 has an axis 12 which is provided with a peripheral annular groove 14 that is flanked by two upstanding rims 16 and 18. The groove 14 is provided with upright, angled corners 20 and 22 defining a support base 24 with a plurality of radially extending openings or bores 26. These bores 26 are circumferentially spaced at regular distances in the groove 24 and are each intended to accommodate the culette 30 and lowermost portion of the pavilion 32 of the precious stone 34. The girdle 36 of the stone contacts the rims 16 and 18.

Thereafter, the relatively soft and deformable metal of the ring body 10 permits the turning over or bending in of the rims 16 and 18 such that each stone is fixed in position with its culette 30 extending into the associated bore 26. See also the perspective view shown in FIG. 1(*a*).

As pointed out in the aforementioned prior art patent, there are certain drawbacks to the above described technique. It requires the careful positioning of the bores 26, and similarly requires the use of identically sized stones or gems, failing which there will be gaps or spaces between adjacent stones when the ring is complete. Another, unmentioned drawback of this technique is that slight variations in the angle of the pavilion 32 relative to the table 38 of the stone, can create difficulties in aligning the stones, i.e. keeping the tables 38 of adjacent stones at the same heights. The aforementioned drawbacks result directly from the fact that the stones 34 lie partially in and are supported on the rim which defines the bores 26. The stones 34 also seal bores 26, which is also undesirable.

The U.S. Pat. No. 4,566,294 patent therefore describes, as shown in FIG. 2 herein, a precious stone setting or mounting consisting of a substantially V-shaped groove 40 that is defined in the mounting to receive in that groove a plurality of precious stones which follow one another, preferably in abutting relationship. Extending above and bordering the mouth 42 of the groove 40 are left side and right side rims 44 and 46 which, like the rims 16 and 18 of FIG. 1, are bendable inwardly to lock the precious stones 34 inside the V-shaped channel or groove 40.

While solving some of the problems shown in prior art FIG. 1, the approach disclosed in prior art FIG. 2 is also less than fully satisfactory because the girdle 36 of the precious stone 34 rests directly against the rather thick inner wall of the groove 40, providing little maneuverability within the channel for adjusting the height of the stones. Moreover, the prior art setting provides a substantially enclosed groove which can collect dirt and which is quite dark, detracting from the sparkle of the precious stones.

SUMMARY OF THE INVENTION

Accordingly, it is an object of the present invention to provide a precious stone setting which is simple to construct and use.

It is another object of the present invention to provide a precious stone setting in which a variety of different stones can be mounted.

It is another object of the present invention to provide a precious stone setting in which precious stones can be mounted in close height alignment.

Yet a further object of the present invention is to provide a precious stone setting comprising a channel for the mounting of precious stones therein, which channel can be easily cleansed to maintain the sparkle of the precious stones.

A still further object of the present invention is to provide a precious stone setting in which precious stones can be mounted in tight formation and which permits more light to enter the mounting to add sparkle and to enhance the appearance of the precious stones.

The foregoing and other objects of the present invention are realized in a precious or semi-precious stone setting for rings, broaches, or virtually any type of jewelry pieces in which precious stones are mounted, which setting is formed as a linear groove or channel in the jewelry piece, with upright rims which can be bent over to retain and secure the precious stones within the setting groove. In accordance with the invention, the precious stones are supported in the groove on the sharp edges of left side and right side ledges which are located inside the groove, near and below the girdle of the precious stones. In other words, the ledges are positioned to engage the pavilions of the stones, e.g. diamonds, at the point which lies very close to or only a short distance away from their girdles.

Substantially most of the pavilion of the diamonds extends inside the channel below the ledge, with the culette facing the bottom or base of the channel, in which there are provided a series of bores. The culette and a portion of the pavilion of each stone may penetrate into a respective bore, as in the prior art, but it need not to. Either way, the stones are not supported on the base, or on the rim of the bores but rather on the aforementioned ledges.

These bores provide several benefits. For example, a cleansing solution may be more easily introduced through the bores into the channels, through the bottom of the jewelry piece. Also, light penetrating into the channel through the bores adds sparkle to enhance the overall appearance. And as noted above, the bores may accommodate, if desired, the culettes and a lower portion of the pavilions.

Since each of the supporting ledges of the present invention comprises a sharp corner edge against which the stones rest and is typically constituted of a small amount of comparatively soft gold or the like, the setting of the present invention provides a degree of give or yield in the vertical direction, permitting the diamond heights to be easily adjusted so that all of their tables, i.e. top visible surfaces, lie substantially at the same elevation.

The invention can be used with round stones, oval stones, square stones, rectangular stones, virtually any shape of stone with little limitations on the ability to mix or arrange the stones as dictated substantially by aesthetic considerations.

In accordance with a modified embodiment of the present invention, a cutout may be provided in one of the upstanding retaining rims of the setting. The girdle of the stone can then be first inserted at an angle into the retaining cutout and thereafter pressed into the precious stone channel. This facilitates the setting of stones in that, to secure the precious stone in place, all that is needed is to inwardly bend over only a single upstanding rim.

Other features and advantages of the present invention will become apparent from the following description of the invention which refers to the accompanying drawings.

BRIEF DESCRIPTION OF THE DRAWINGS

FIG. 1(*a*) is a perspective of the prior art setting of FIG. 1.

FIG. 3(*a*) shows a detail of the setting of FIG. 3.

DETAILED DESCRIPTION OF EMBODIMENTS OF THE INVENTION

Figure 3:
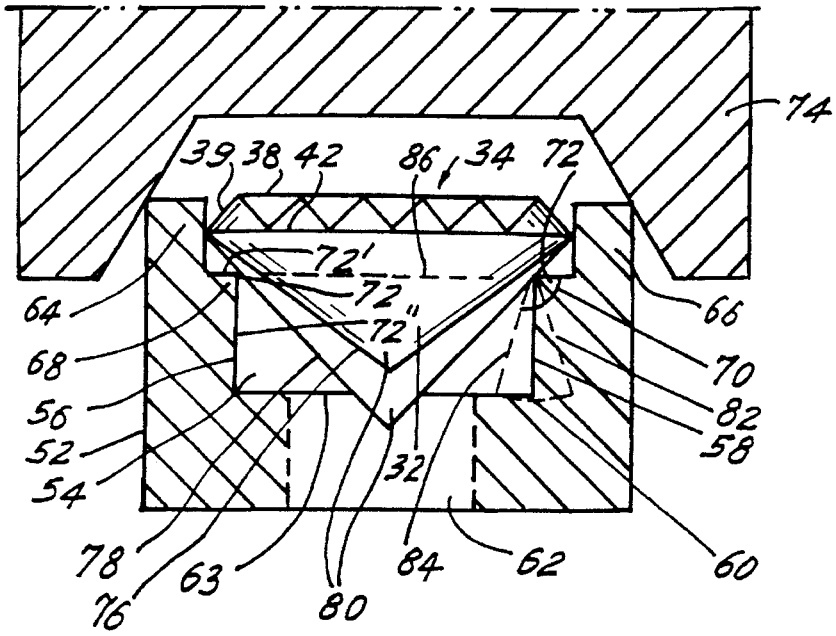
FIG. 3 is a cross-section through a first embodiment of a precious stone mounting or setting in accordance with a first embodiment of the present invention.
Figure 3A:
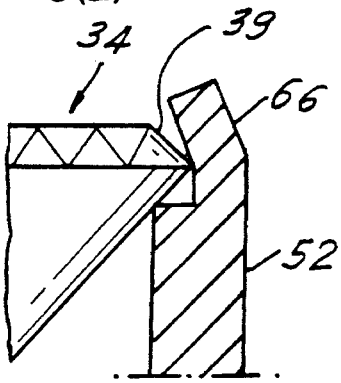

With reference to the drawings, FIG. 3 illustrates a cross-section through a setting 50 which can be a part of virtually any type of a jewelry piece, and which includes a body 52 in which there is defined a linearly extending channel 54 for the mounting therein of a series of precious stones 34, e.g. diamonds.

The channel 54 is defined by a left side wall 56, a right side wall 58, and a base 60. The base 60 is punctuated by a series of spaced bores 62 which are separated by distances that depend on the sizes of the diamonds 34.

Extending above the side walls 56 and 58 are a left side rim 64 and a right side rim 66 which are designed to be bent inwardly against the crowns 39 of the diamonds 34 to retain and secure the diamonds in place in the channel 54, as shown in FIG. 3(*a*).

Defined between the side walls 56 and 58 and the rims 64 and 66 are left and right side ledges 68 and 70, each of which includes a sharp biting edge 72, which is defined by the intersection of the two surfaces 72' and 72". The edges 72 constitute the support structure against which the diamonds 34 rest by being engaged at their pavilions at the point which is located almost right at or very closely adjacent their girdles 36. In assembling a jewelry piece, the diamonds 34 are simply inserted into the channel 54 and thereafter a small amount of pressure is applied to the table 38 of the diamond 34 to fix its height relative to the setting 50.

Since the diamonds 34 rest on the edges 72 of the ledges 68 and 70, which edges comprise a small amount of yielding gold, the mere application of a small pressure causes the material of the setting to yield at the edges 72, thus enabling precise adjustment and stable positioning of the diamonds as shown. The subsequent inward bending of the rims 64 and 66, for example, with the aid of the bending tool 74 enables rapid setting of the diamonds in a consistent, easy to implement, and reliable manner.

As shown in FIG. 3, the present invention inherently compensates for variations in the shape or angle of the pavilions 32 of the diamonds 34. That is, regardless of whether the pavilion is defined by the surface identified by reference numeral 76 or 78, the diamond 34 can be set at the same height with the only difference being the amount by which the sharp edges 72 are deformed.

Furthermore, in accordance with the present invention, the culette 80 of the diamond 34 may reach only close to the base 60 of the channel 54 or, alternatively, may penetrate into the bores 62, without touching the rim 63 of the bores 62 as shown. In any event, note that no portion of the diamond actually rests against the base 60 of the channel 54 or even the rim 63. Therefore, the size and shape of the bores 62 can be made quite large to provide considerable flexibility in the placement of the diamonds and in assuring that they will tightly abut one another (as viewed from outside the setting, facing the tables 38 of the diamonds 34).

FIG. 3 also illustrates that the side walls 56 and 58, which are preferably vertically disposed, may extend at slight angles relative to the base 60. These different orientations of the walls 56 and 58 are indicated by the dotted lines 82 and 84. It is preferred however, that the sharp edges 72 which engage the diamonds 34 and which are defined by the intersection of the surfaces of the walls 72 and 82 or 84 be such that the angles between these surfaces is in the range of about 75° to 130°.

An important distinguishing feature of the present invention is the location of the ledges 72 at the point such that they engage the pavilion 32 of the diamonds 34 very close below their girdles 36, or at least in the upper half of the pavilion 32 above the pavilion bisecting line 86, as illustrated in FIG. 3.

Figure 4:
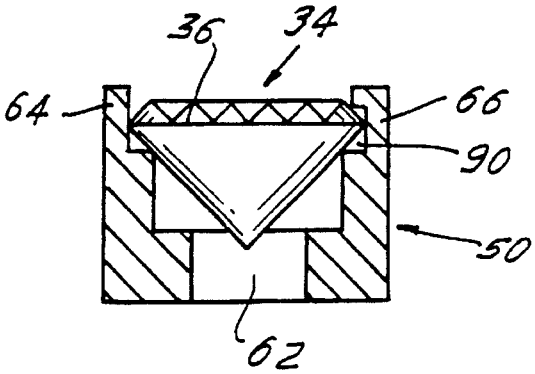
FIG. 4 illustrates a second embodiment of a precious stone mounting in accordance with the present invention.

In accordance with the somewhat modified setting illustrated in FIG. 4, one of the rims, for example the rim 66, is provided with a cutout 90 in which the girdle 36 of the diamond 34 is accommodated. This embodiment is practically identical to the embodiment of FIG. 3, but is expected to substantially facilitate the rapidity in which diamonds or other precious stones can be mounted in the setting 50 of the present invention.

Figure 5:
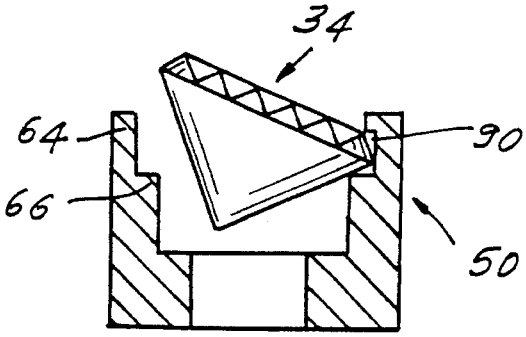
FIG. 5 illustrates the manner in which a precious stone can be inserted into the precious stone setting of FIG. 4.

With reference to FIG. 5, it will be seen that the diamond 34 is held at that slight angle with its girdle 36 inserted to engage the cutout 90. Thereafter, with the application of a slight force, the diamond 34 is pressed inwardly until the other side of the diamond comes to rest against the ledge 68. The mounting is completed with the inward bending of the left side rim 64, as before.

Figure 6:
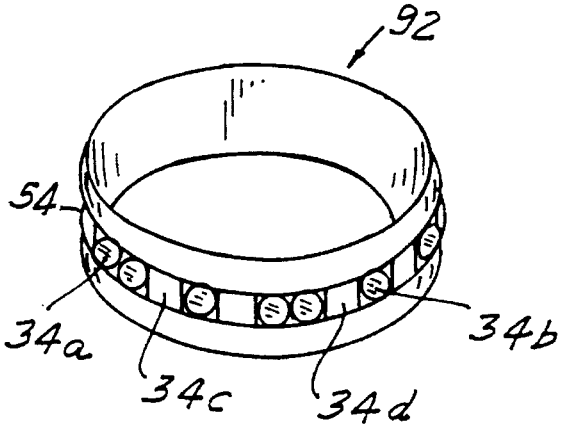
FIG. 6 is a perspective drawing of a ring embodying the concept of the present invention.

FIG. 6 illustrates an embodiment of the present invention in the form of a setting for a ring 92. As shown, the ring 92 is formed with a channel 54 in which there are mounted a series of precious stones in line, following one another. For the purposes of demonstrating the flexibility of the present design, the illustrated stones include round stones 34*a*, oval stones 34*b*, rectangular stones 34*c* and square stones 34*d*. However, the concept of the invention is not limited to any particular shape of stone, and any type of stone can be accommodated. Indeed, stones of different shape can be combined in the same setting as shown in FIG. 6.

Figure 2:
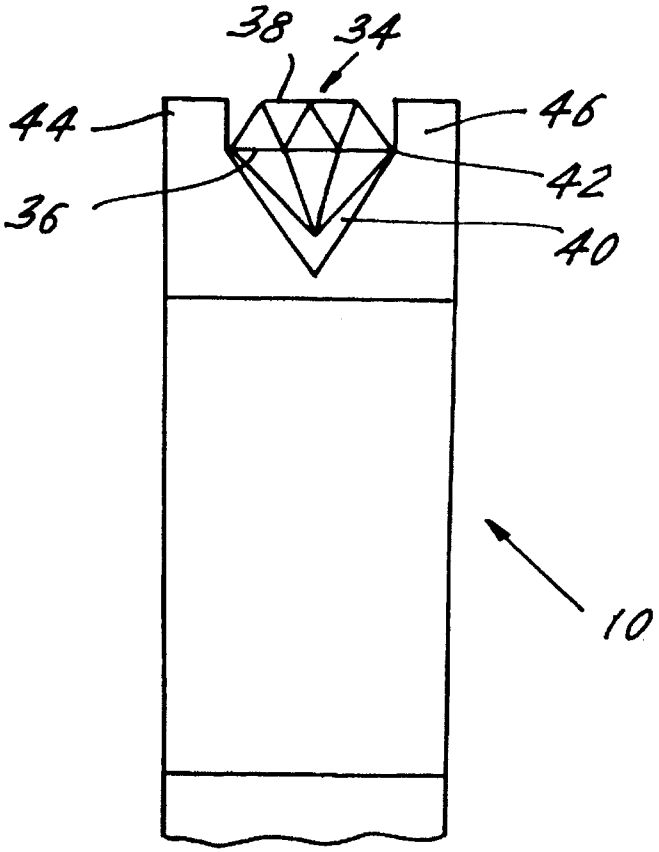
FIG. 2 PRIOR ART
FIG. 2 illustrates another prior art precious stone setting.
Figure 1:
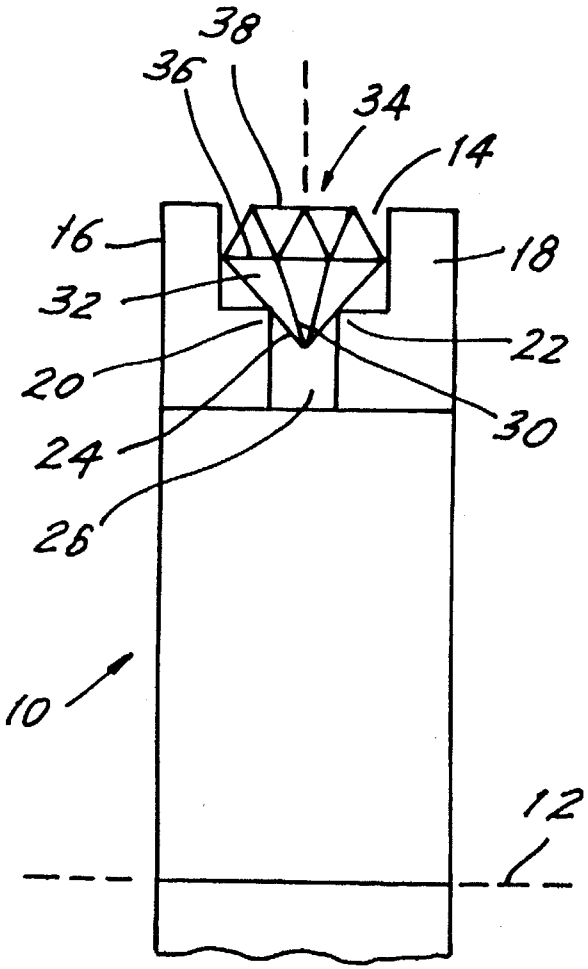
FIG. 1 PRIOR ART
FIG. 1 illustrates a precious stone setting in accordance with a first prior art embodiment.
Figure 1A:
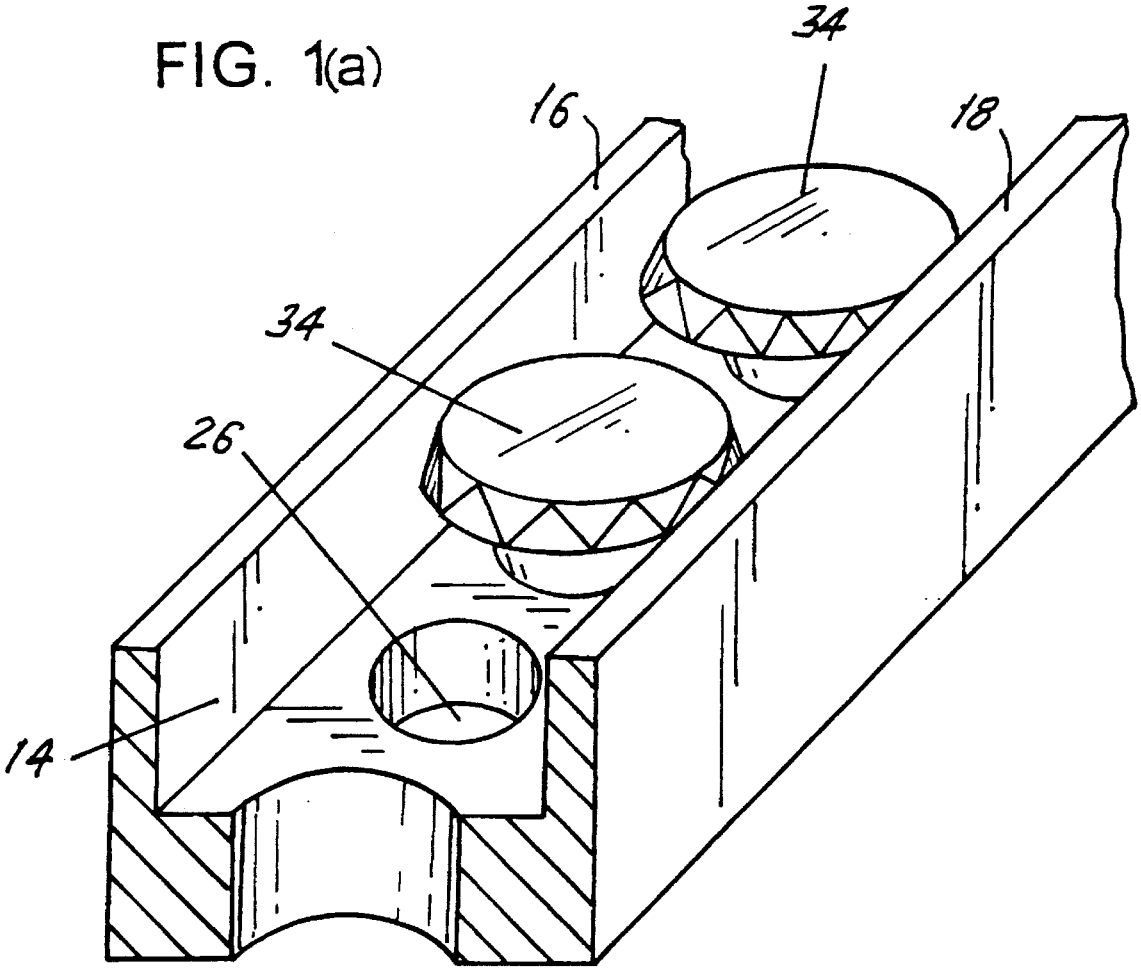
Figure 7:
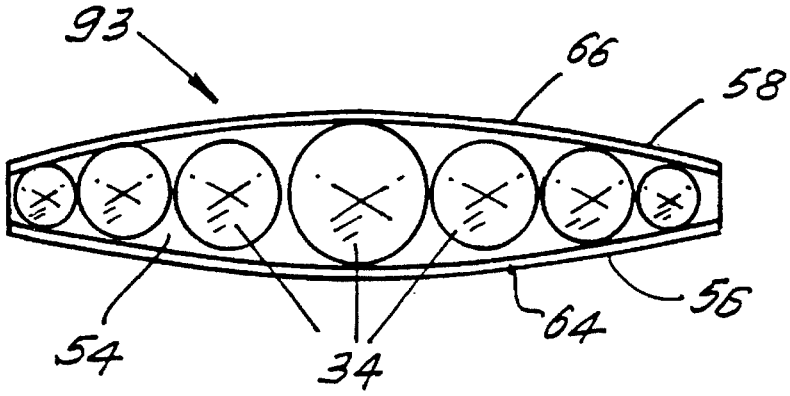
FIG. 7 is a top view of a third embodiment of the present invention.

In accordance with FIG. 7, the side walls 56 and 58 and the rims 66 and 64 do not extend parallel to one another. Rather, this define the channel 54 to have a stretched oval channel shape. This enables producing a ring 93 with diamonds 34 that taper in diametrical size as shown.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A jewelry piece, comprising:

a plurality of precious stones and a setting for the precious stones;

the setting including:

a body;

a linear channel in the body, flanked by a left wall and a right wall;

a first left side and upwardly oriented rim extending from the left wall and a second right side and upwardly oriented rim extending from the right wall;

a channel base, the walls extending between the channel base and the rims;

ledge means between the walls and the rims for supporting the precious stones by engaging a pavilion portion of the precious stones at the region on the pavilion that lies adjacent a girdle of the precious stones; and the ledge means including a sharp edge made of a soft, yielding material, the sharp edge being defined by two surfaces which meet at an angle, the sharp edge being located to engage the precious stones at a region on the pavilion that lies adjacent a girdle of the precious stones and in a manner wherein insertion of the precious stones into the setting deforms the sharp edge.

2. The jewelry piece of claim 1, in which the angle of the sharp edge is between about 75° to 130°.

3. The jewelry piece of claim 1, in which the ledge means comprises a left side ledge and a right side ledge.

4. The jewelry piece of claim 3, in which the two surfaces which define the sharp edge meet at an angle of about 90°.

5. The jewelry piece of claim 3, in which the left wall and the right wall of the setting extend substantially vertically and substantially perpendicularly to the girdle of the precious stones.

6. The jewelry piece of claim 3, further comprising a plurality of bores defined in the setting and extending through the channel base of the setting.

7. The jewelry piece of claim 6, in which the culettes of the precious stones extend into the bores.

8. The jewelry piece of claim 3, wherein the rims are bent inwardly to engage and bear against a crown of the precious stones.

9. The jewelry piece of claim 3, further comprising a cutout in at least one of the rims, the cutout being formed in the at least one of the rims at a location to engage the girdle of the precious stones.

10. The jewelry piece of claim 3, in which the precious stones are diamonds.

11. The jewelry piece of claim 3, in which the precious stones have a shape selected from a group of precious stone shapes including rounds, ovals, squares, and rectangular shapes.

12. The jewelry piece of claim 3, in which the jewelry piece comprises a ring.

13. The jewelry piece of claim 3, in which the linear channel has a stretched oval shape.

14. A method for mounting a plurality of precious stones in a setting, the method including the steps of:

providing a setting including a body, a linear channel on the body, flanked by a left wall and a right wall, a first left side rim extending from the left wall and a second right side rim extending from the right wall and a channel base, wherein the walls extend between the channel base and the rims;

providing a left side and a right side ledge within the linear channel between the walls and the rims, each of the ledges including a respective sharp edge made of a soft, yielding material, the sharp edge being defined by two surfaces which meet at an angle of between about 75° to 130°;

inserting the plurality of precious stones inside the channel such that substantially the entirety of a pavilion portion of the precious stones is located within the channel; and bending the left and right rims to the right and to the left, respectively, to lock and secure the precious stones inside the channel and such that the sharp edge is deformed by the insertion of the plurality of precious stones inside the channel.

15. The method of claim 14, in which one of the rims has a cutout and including inserting the precious stones at an angle into the channel such that a girdle of the precious stones engages the cutout and thereafter pressing the rest of the precious stones into the channel and completing the setting by bending the at least one of the rims inwardly to secure the precious stones in place.

* * * * *